United States Patent [19]

Kobori et al.

[11] Patent Number: 5,065,552

[45] Date of Patent: Nov. 19, 1991

[54] ACTIVE SEISMIC RESPONSE CONTROL SYSTEM FOR USE IN STRUCTURE

[75] Inventors: Takuji Kobori; Motoichi Takahashi; Tadashi Nasu; Naoki Niwa; Narito Kurata; Junichi Hirai; Yoshinori Adachi, all of Tokyo, Japan

[73] Assignee: Kajima Corporation, Tokyo, Japan

[21] Appl. No.: 475,367

[22] Filed: Feb. 5, 1990

[30] Foreign Application Priority Data

| | | | |
|---|---|---|---|
| Feb. 7, 1989 | [JP] | Japan | 1-27901 |
| Feb. 7, 1989 | [JP] | Japan | 1-27905 |
| Feb. 23, 1989 | [JP] | Japan | 1-43565 |
| Mar. 14, 1989 | [JP] | Japan | 1-61237 |

[51] Int. Cl.[5] ..... E04H 9/00

[52] U.S. Cl. ..... 52/1; 52/167 R; 52/167 CB

[58] Field of Search ..... 52/167 CB, 167 R, 1

[56] References Cited

U.S. PATENT DOCUMENTS

| | | | |
|---|---|---|---|
| 4,799,339 | 1/1989 | Kobori et al. | 52/167 CB |
| 4,890,430 | 1/1990 | Kobori et al. | 52/167 CB |
| 4,901,486 | 2/1990 | Kobori et al. | 52/167 |
| 4,922,667 | 5/1990 | Kobori et al. | 52/167 CB |
| 4,959,934 | 10/1990 | Yamada et al. | 52/167 |
| 4,964,246 | 10/1990 | Kobori et al. | 52/167 |

FOREIGN PATENT DOCUMENTS

| | | |
|---|---|---|
| 12743 | 1/1977 | Japan . |
| 45141 | 4/1977 | Japan . |
| 19655 | 2/1978 | Japan . |
| 19656 | 2/1978 | Japan . |

*Primary Examiner*—David A. Scherbel
*Assistant Examiner*—Linda J. Watson
*Attorney, Agent, or Firm*—James H. Tilberry

[57] ABSTRACT

An active seismic response control system includes a variable damping device provided between posts, beams and braces of a structure, wherein the response of the frame is reduced by controlling the variable damping device when an earthquake or strong wind occurs to give a damping force to the frame. The response of the structure is determined by the steps of judging with a computer the optimal damping force or control force to be applied to the structure on the basis of information obtained from sensors in response to the disturbance, and then controlling the coefficient of damping of the variable damping device.

15 Claims, 8 Drawing Sheets

ACTIVE SEISMIC RESPONSE CONTROL SYSTEM FOR USE IN STRUCTURE

BACKGROUND OF THE INVENTION

1. Field of the Invention

The field of invention relates to active seismic response control systems for use in structures, and more particularly to active seismic response control systems in which variable resistance connecting devices are provided in frames of structures to interconnect frame bodies and variable stiffness elements, or to interconnect the variable stiffness elements themselves provided in the frame wherein external vibrational forces such as earthquake tremors and wind are controlled by the use of computer technology to reduce the vibrational response of the structure to such external vibrational forces.

2. Description of the Prior Art

Applicants have heretofore proposed various types of active seismic response control systems and variable stiffness structures, each of which has a variable stiffness element in the form of a brace or a wall incorporated in the post and beam frames of a structure. The stiffness of the variable stiffness elements per se and/or the combination of a frame body and variable stiffness elements is varied responsive to analysis of the characteristics of the external vibrational forces by computer means to render the structure non-resonant relative to the external vibrational forces to attain the safety of the structure.

Prior art active seismic response control systems primarily observe and deal with the relationship between the predominant periods of seismic and/or wind vibrations and the natural frequency of the structure. Harmonic resonance of the structure during the predominant periods of external vibrations is avoided by changing the natural frequencies of the structure, thereby attenuating the response of the structure to the external vibrations. However, conventional seismic response control systems do not necessarily provide optimal control in cases where the seismic disturbances have indistinct predominant periods or a plurality of predominant periods.

SUMMARY OF THE INVENTION

The present invention provides an active seismic response control system in which a variable resistance connecting device is interposed between a frame body and a variable stiffness element, or in the variable stiffness element. The system also includes response measuring means, control force determining means, and control command generating means.

The optimal control force u shown in FIG. 5 is determined by computer means according to the construction of the frame F, to which the present invention is applied. By analyzing the relationship between the connecting device and the control force, a command is sent by the computer means to the connecting device to provide a control force appropriate for reducing the response of the frame body to external vibrational forces.

The inventive connecting device is referred to as a cylinder lock 10, FIG. 3, comprising a hydraulic cylinder and a piston rod of a double-rod type reciprocating in the cylinder. The cylinder lock may be connected, for example, between the frame and a variable stiffness element such as a frame cross brace. As shown in FIG. 3, the cylinder lock also includes a high-speed switch valve 15 serving as an orifice in an oil path 14 for interconnecting two oil pressure chambers 13A and 13B located on opposite sides of a piston 12*a*. The switch valve 15 is actuated to regulate the control force by opening and closing at computer-controlled variable speeds, in response to pulsed signals, as shown in FIG. 4.

When an external vibrational force is impressed on a structure, the responses of the structure frame and related parts are detected by sensors, such as displacement meters, speedometers or accelerometers, serving as the response measuring means. The optimal control force for the frame, for example, is calculated by the control force determining means in a computer program, and then a control command for providing the optimal control force is given to the connecting device by the control command generating means to thereby control the vibration of the structure.

While the above-described system controls the vibration of the structure by varying the control force, in another system the connecting device is used as a variable damping means capable of varying the damping coeffecient of the structure as a means to control the vibration of the structure. In another system, the response to displacement and to acceleration of the structure may be controlled either jointly or severally.

OBJECTS OF THE INVENTION

It is an object of the present invention to provide an active seismic response control system which varies and actively regulates a control force according to a determined response calculated to best protect a structure from external vibrations.

Another object of the present invention is to adjust the connecting condition of a variable resistance connecting device provided between the frame body and the variable stiffness element relative to a disturbance such as a seismic motion, whereby a control force applied to the frame body in the form of a damping force is controlled to reduce the response of the structure.

A further object of the present invention is to analyze the relationship between the control force and the connecting device while calculating an optimal control force by the use of a computer, whereby a feed-back control, which is a function of the response of the structure, is provided to protect the structure from harmful over-response.

DETAILED DESCRIPTION OF THE PREFERRED EMBODIMENTS

Hereinafter will be described a preferred embodiment of an active seismic response control system according to the present invention.

Figure 1:
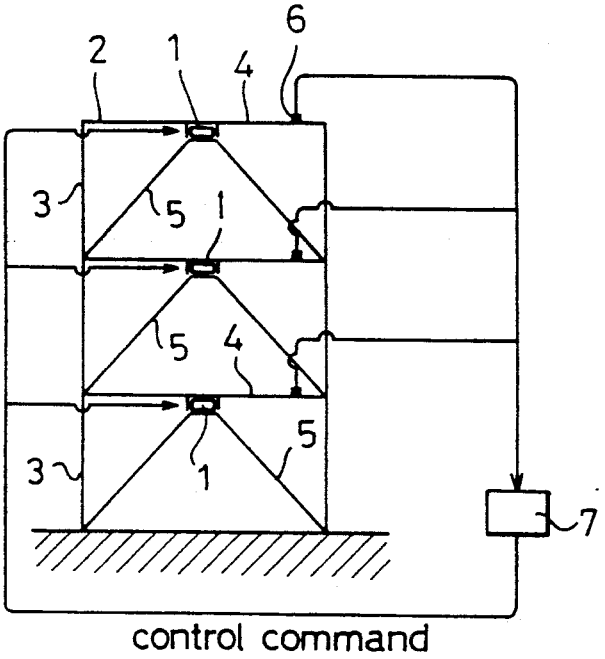
FIG. 1 is a schematic elevational view of a frame of a structure showing an application of an active seismic response control system according to the present invention.
Figure 2:
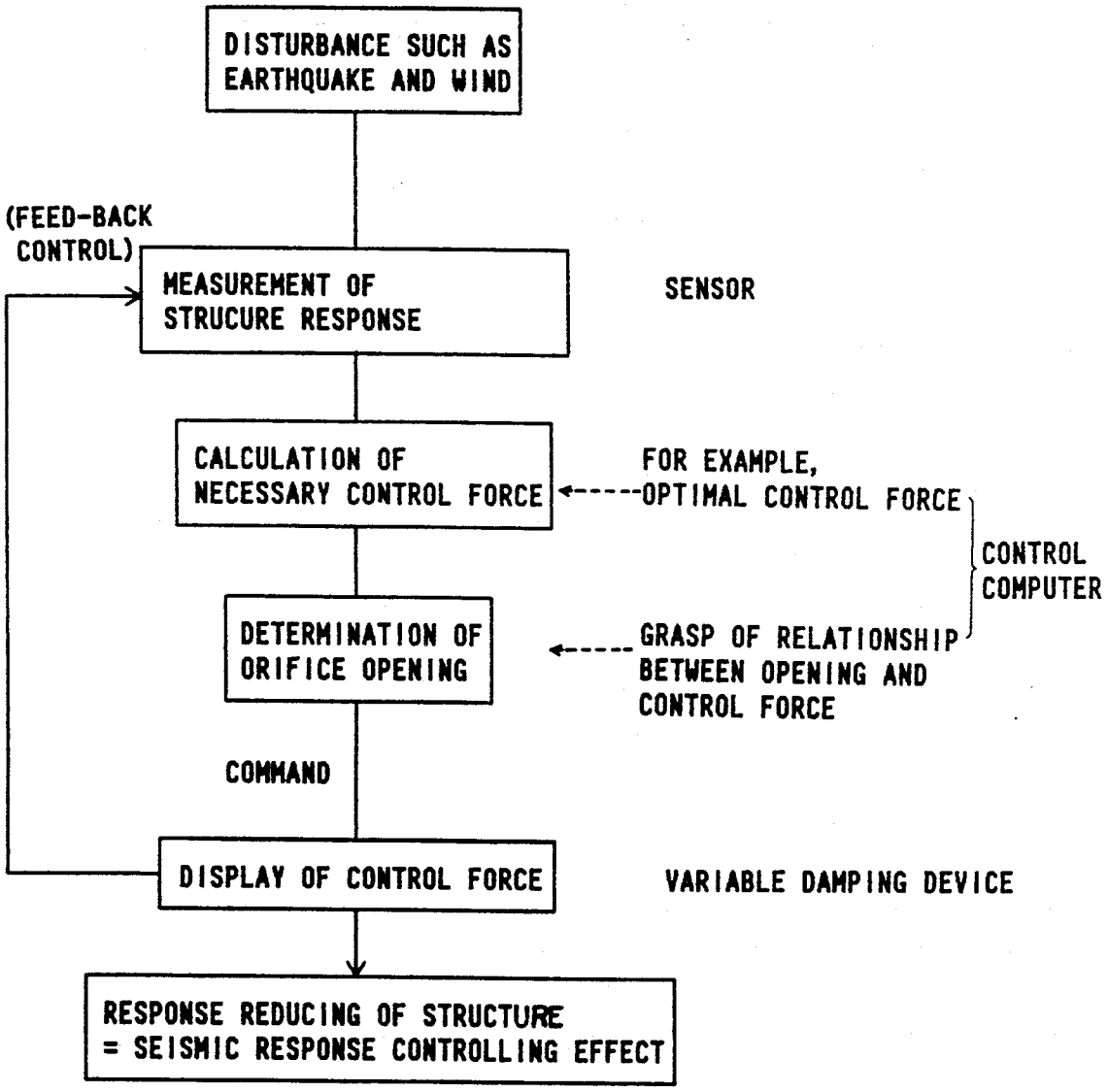
FIG. 2 is a flow chart showing a control in accordance with the active seismic response control system of the present invention.

FIG. 1 schematically shows an application of the active seismic response control system according to the present invention, in which a cylinder lock device 1 is interposed between a frame body 2 consisting of a post 3 and a beam 4 and an inverted V-shaped brace 5 serving as a variable stiffness element incorporated in the frame body 2 on each story. The response (amplitude, speed, and/or acceleration) of a structure subjected to the tremors of an earthquake is sensed by a response sensor 6 installed on the structure, and the optimal response is obtained by a computer 7 to generate a control command. FIG. 2 is a flow chart of the operation of this control system.

More specifically, the control using the cylinder lock device 1 functions as follows:

(1) The relationship between the switch valve 15 and the force impressed on the variable stiffness element 5 is analyzed by the computer 7.

(2) The necessary control force is calculated on the basis of the response condition (displacement x, speed $\dot{x}$, and/or acceleration ) of the structure.

(3) Computer 7 commands the switch valve 15 to adjust appropriately to obtain the necessary control force. Switch valve 15 opens and closes an orifice in order to provide a control force proportional to the second power of the relative speed.

(4) The cylinder lock device 1 generates the control force according to the computer command to thereby reduce the response of the structure.

Figure 6:
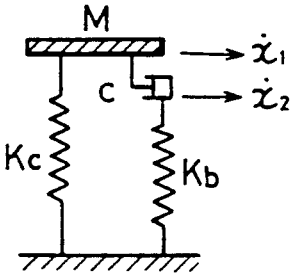
FIG. 6 is a schematic elevational view of a dynamic model of a frame according to the present invention.

In the case where the cylinder lock device 1 is used, if the direction of the response is the same as that of the optimal control force, the cylinder lock device can apply a control force. If the direction of the response is opposite to that of the optimal control force, the cylinder lock device cannot apply a control force. In the latter case, the control force is controlled to be set to zero (the switch valve is assumed to be fully open). This relationship is represented by a formula where the control is executed on the basis of the speed ($\dot{x}$) and the relative speed of the frame body to the brace in the dynamic model as shown in FIG. 6, as follows:

$$\Delta\dot{x}=\dot{x}_1-\dot{x}_2$$

When the product $u \cdot \Delta x$ of the relative speed and the optimal control force u is negative, the control is executed by the control force u' which is equal to u. When the product as noted above is positive, the control force u' is assumed to be zero. That is, $$u' = u\frac{1 - sgn\,(u \cdot \Delta\dot{x})}{2}$$

$$\left( sgn\,(u \cdot \Delta\dot{x}) = \begin{cases} +1\ (u \cdot \Delta\dot{x} \geqq 0) \\ -1\ (u \cdot \Delta\dot{x} < 0) \end{cases} \right)$$

Next will be described an embodiment of a variable damping device serving as the connecting device used in the active seismic response control system according to the present invention.

Figure 7:
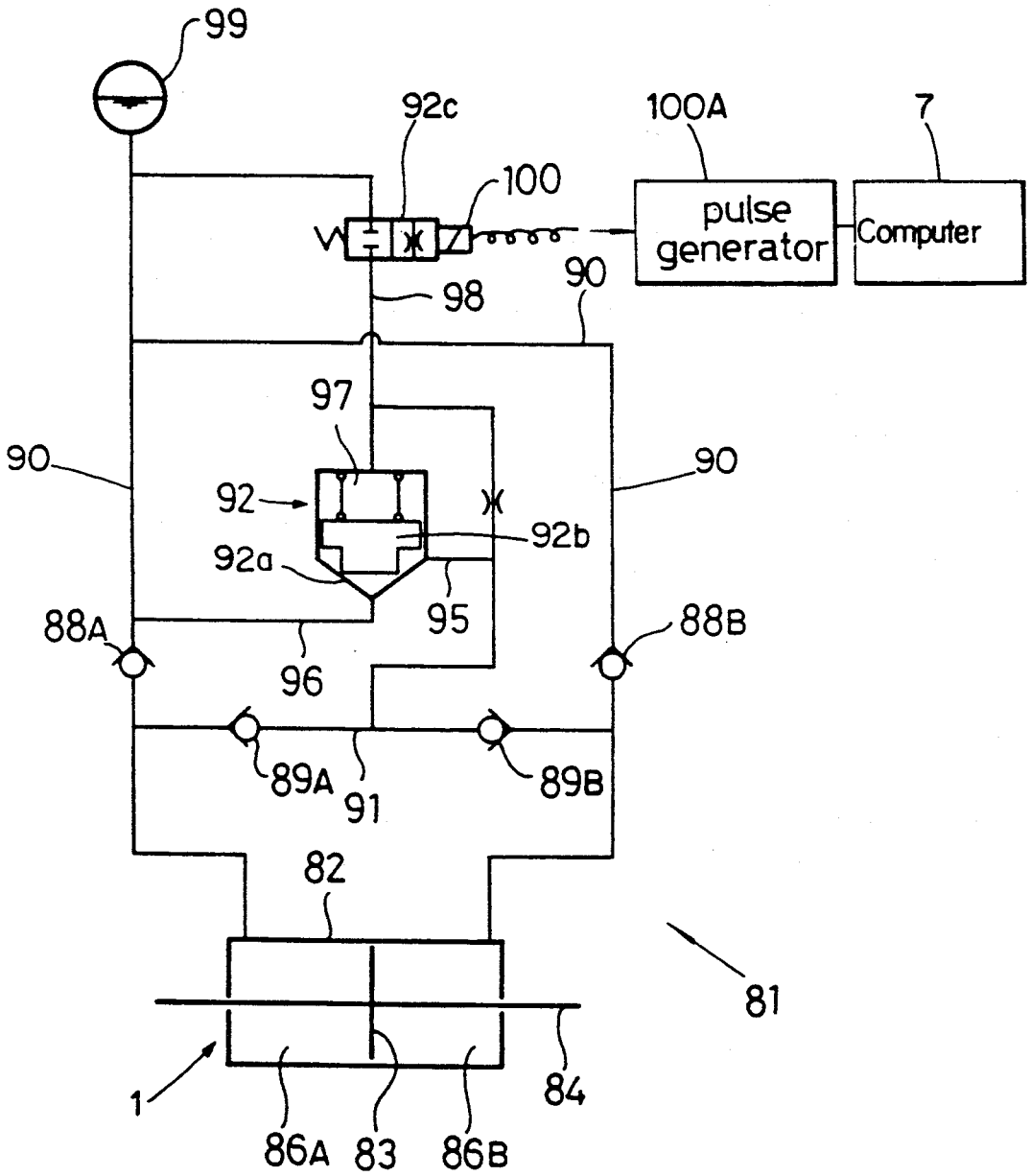
FIG. 7 is a hydraulic circuit diagram showing a specific example of a cylinder lock device for use in the active seismic response control system according to the present invention.

A preferred embodiment 81 of the invention, schematically shown in FIG. 7, comprises cylinder lock 1; flow regulating valve 92; shut-off valve 92c; solenoid 100; pulse generator 100A; and computer 7. A piston 83 of a double-rod type reciprocating in a cylinder body 82 is provided with left and right oil pressure chambers 86A and 86B located on the left and right sides respectively of the piston 83, and pressurized oil in the left and right oil pressure chambers is adapted to stop or flow for fixing or moving piston 83 leftward or rightward.

In a first preferred embodiment of the invention, the cylinder 82 is connected to the frame body of the structure, and the rod 84 is connected to the variable stiffness element. In a second preferred embodiment of the invention, the rod 84 is connected to the frame body and the cylinder 82 is connected to the variable stiffness element. In a third preferred embodiment of the invention, both the cylinder 82 and the rod 84 may be connected to a variable stiffness element 5. The left and right oil pressure chambers are provided with outflow check valves 88A and 88B, respectively, for blocking the outflow of pressurized oil from the corresponding oil pressure chamber. Inflow check valves 89A and 89B are for blocking the inflow of pressurized oil into the corresponding oil pressure chambers 86A and 86B, respectively. Inflow path 90 interconnects the left and right outflow blocking check valves 88A and 88B, and an outflow path 91 interconnects the left and right inflow blocking check valves 89A and 89B.

Figure 3:
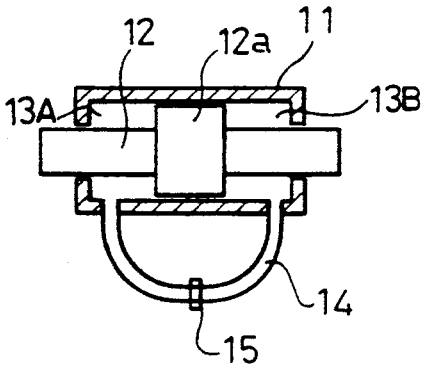
FIG. 3 is a schematic view showing a cylinder lock device serving as a connecting device for use in the active seismic response control system of the present invention.
Figure 5:
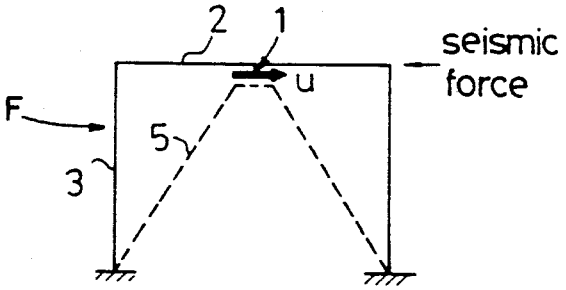
FIG. 5 is a schematic elevational view of a braced frame of a structure protected by the present invention.

A flow regulating valve 92 is provided in the connecting position of the inflow path 90 and the outflow path 91, and is controlled to be opened or closed in response to a pulse signal from a pulse generator 100A connected to the computer 7. The variable damping device 81, when considered conceptually with reference to the schematic showing of the cylinder lock 1 of FIG. 3, provides a variable stiffness device for varying the stiffness of the frame body by controlling the locked condition, in which the flow regulating valve 92 is completely closed, and the free condition, in which the flow regulating valve 92 is completely open. In addition, the various damping coefficients c are obtained by regulating the opening of the flow regulating valve 92 to delicately regulate the connecting conditions between the completely locked condition and the completely free condition of the flow regulating valve. By appropriate regulation, the natural period and the damping constant h of the frame body are varied depending upon the damping coefficient c and the vibrational condition of the frame body. Optionally, the damping force may be used as the control force.

Figure 4:
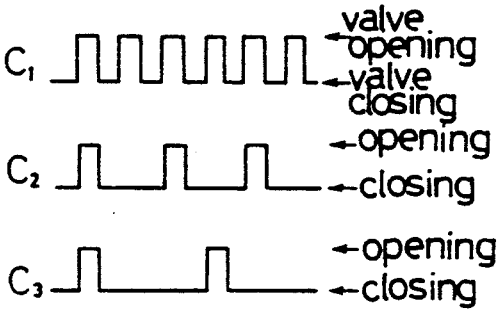
FIG. 4 is a graph showing the relationship between a pulse signal and the opening and closing of the valve controlling the cylinder lock device of FIG. 3.

The opening of the flow regulating valve 92 is contemplated in relation to time by regulating the interval of pulse signals provided from the pulse generator 100A. As shown in FIG. 4, various openings and various damping coefficients c, accompanying the change of the opening, are realized by varying the times during which the flow regulating valve 92 is open.

The flow regulating valve 92 comprises a valve body **92*a* and a change-over valve 92*b*. The valve body 92*a* has an inlet port 95 and an outlet port 96 provided on one end of the valve body, a back pressure port 97 provided on the other end of the valve body, and a shut-off valve 92*c* provided on a bypass flow path 98 providing communication between the back pressure port 97 and the inlet port 95. Shut-off valve 92*c* is capable of blocking the outflow of pressurized oil toward the back pressure port 97, and is opened and closed in response to a pulse signal provided from the pulse generator 100A upon the reception of a command from the computer 7, thereby controlling the opening and closing of the shut-off valve 92*c*. An accumulator 99 may be provided on either the inflow path 90 or the outflow path 91** in order to compensate for the volumetric change of fluid caused by temperature fluctuation and to compress the working fluid.

Next will be described the operating condition of the variable damping device 81 in accordance with the present embodiment.

(1) Flow regulating valve 92 is open.

When the shut-off valve **92*c* is opened, the piston 83 is shifted leftward so that the pressurized oil in the left oil pressure chamber 86A flows through the inflow blocking check valve 89A and the outflow path 91 to lift up the change-over valve 92*b*. Since the left outflow blocking check valve 88A and the right inflow blocking check valve 89B are closed due to the pressurized oil, the pressurized oil flows from the flow regulating valve 92 through the inflow path 90 and the right outflow blocking check valve 88B. Accordingly, the pressurized oil flows from the left oil pressure chamber 86A to the right oil pressure chamber 86B, thereby causing the piston 83** to shift leftward.

When the piston 83 is shifted to the right, the pressurized oil in the right oil pressure chamber 86B flows through the inflow blocking check valve 89B and the outflow path 91 to lift up the change-over valve **92*b*. Since the right outflow blocking check valve 88B and the left inflow blocking check valve 89A are pressure closed, the pressurized oil flows from the flow regulating valve 92 through the inflow path 90 and the left outflow blocking check valve 88A. Thus the pressurized oil flows from the right oil pressure chamber 86B to the left oil pressure chamber 86A, thereby causing the piston 83** to shift to the right.

(2) Flow regulating valve is closed.

When the shut-off valve **92*c* is closed and a leftward external force is applied to the piston 83, the oil pressure in the system is equalized and movement of the piston 83 is blocked. When rightward external force is applied to the piston 83, the movement of the piston 83** is similarly blocked.

FIGS. 8 through 15 show various applications of variable damping cylinder lock devices 1 in operative relation to the frame body 102 of the structure.

Figure 8:
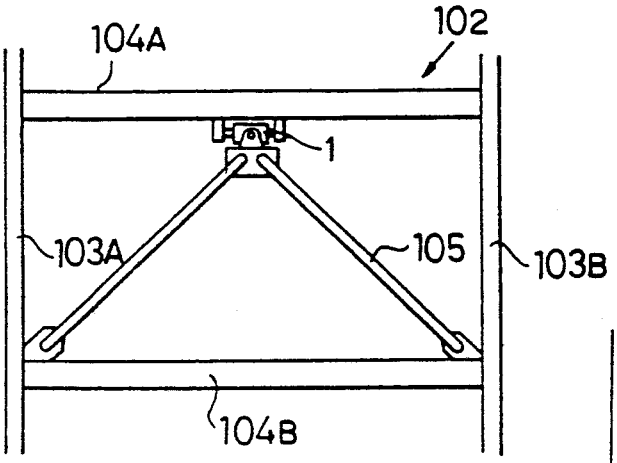
FIGS. 8 through 15 are schematic elevational views showing various positions of variable damping devices applied to the frames of variable damping structures, in accordance with the present invention.

In the embodiment shown in FIG. 8, a variable damping cylinder lock device 1 is interposed between a beam 104 and an inverted V-shaped brace 105 serving as the variable stiffness element.

Figure 9:
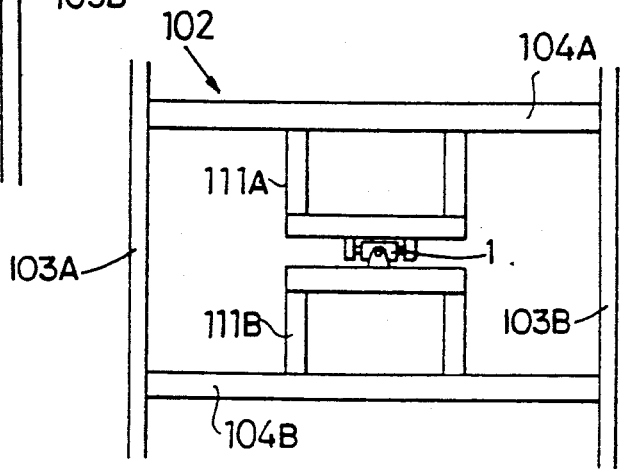

In the embodiment shown in FIG. 9, the variable damping cylinder lock device 1 is interposed between U-shaped braces 111A and 111B vertically projecting from upper and lower beams 104A and 104B to constitute a moment resistance frame serving as the variable stiffness element.

Figure 10:
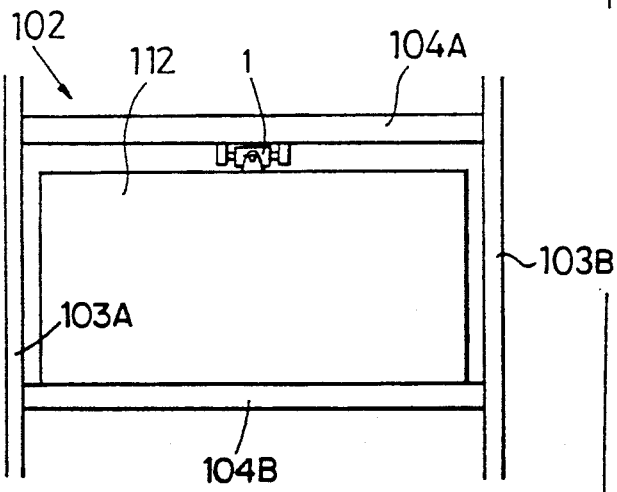

In the embodiment shown in FIG. 10, the variable damping cylinder lock device 1 is interposed between the beam 104A and an earthquake-resisting wall 112 serving as the variable stiffness element.

Figure 11:
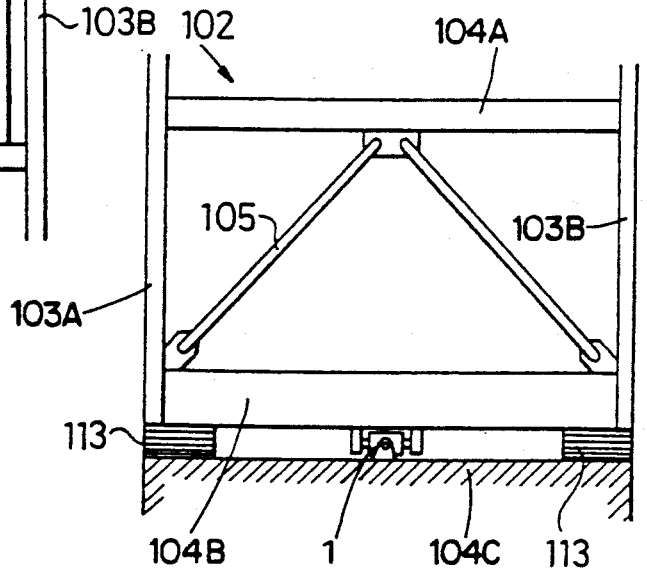

In the embodiment shown in FIG. 11, the variable damping cylinder lock device 1 is interposed between the foundation 104C and a beam 104B, in combination with laminated rubber base isolation members 113. In this embodiment, the variable damping locking device 1 serves as a damper in the base isolation structure. The variable stiffness element in this embodiment is considered to be the foundation 104C of the structure.

Figure 12:
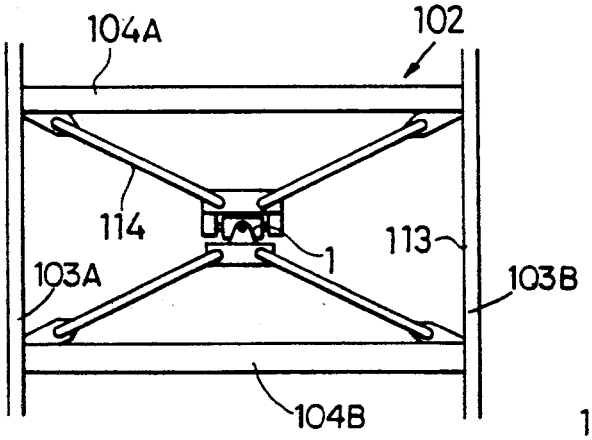

In the embodiment shown in FIG. 12, an X-shaped brace 114 provided in frame body 102 is used as the variable stiffness element, and the variable damping cylinder lock device 1 is horizontally interposed in the center of the X-shaped brace.

Figure 13:
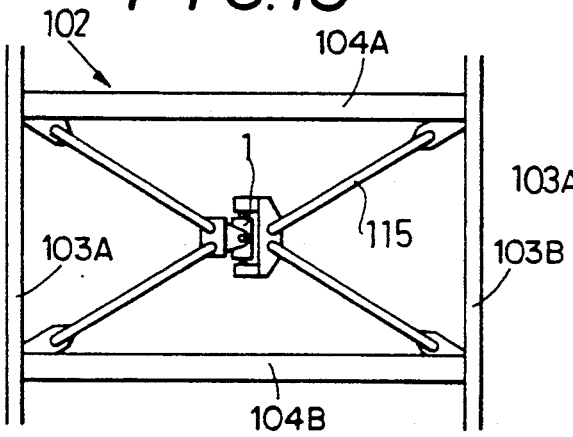

The embodiment shown in FIG. 13 is applied to the X-shaped brace 115, similar to the embodiment shown in FIG. 12. In the embodiment shown in FIG. 13, the variable damping cylinder lock device 1 is vertically interposed.

Figure 14:
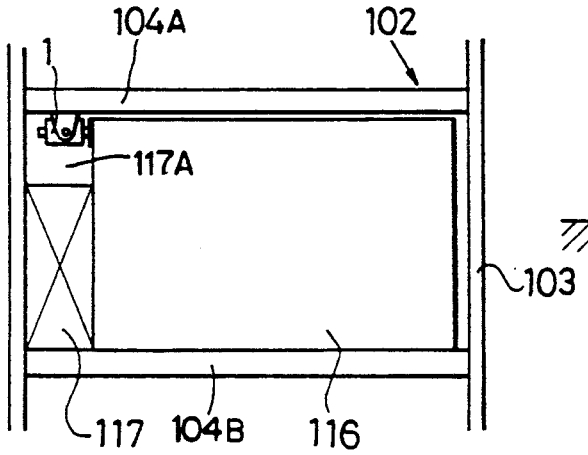

In the embodiment shown in FIG. 14, similar to the embodiment shown in FIG. 10, the variable damping cylinder lock device 1 is secured in an opening 117A above a doorway 117 between beam 104A and wall 116, serving as the variable stiffness element.

Figure 15:
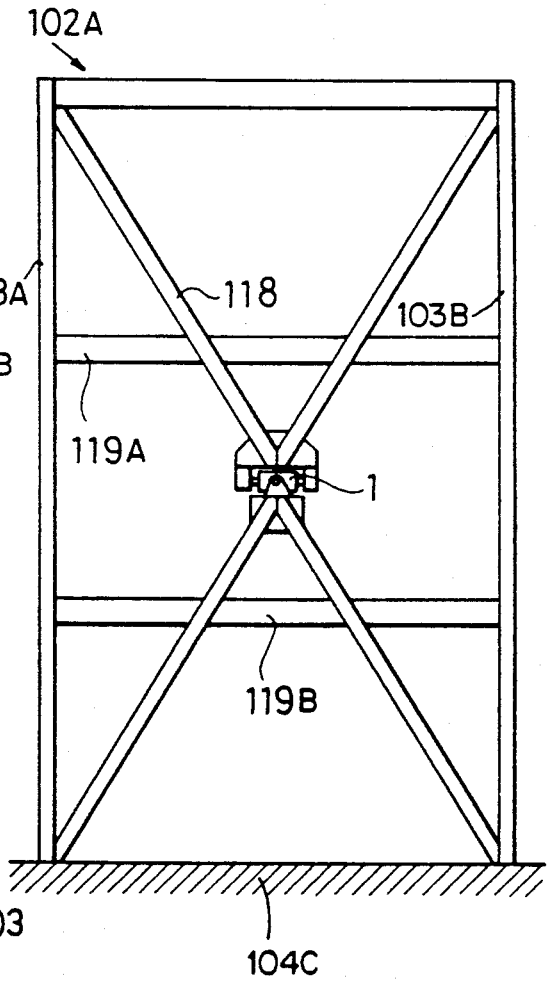

In the embodiment shown in FIG. 15, the variable damping cylinder lock device 1 is interposed in the center of an X-shaped brace 118 in a large frame 102A, and intermediate large beams 119A and 119B and the brace 118, which are separated from each other.

FIGS. 16 through 27 show embodiments of the invention in which the active seismic response control systems are applied to structures having large bending deformation, such as high-rise buildings. The vibration of high-rise buildings due to earthquake and wind includes the shearing deformation of the frame caused by bending of posts and beams and by bending deformation of the whole frame caused by axial deformation of the posts. Normally, the vibration of a building consists of the total of the aforementioned two deformations, and the greater the height of a slender building relative to its width, the greater is the bending deformation of the whole frame.

Many conventional variable stiffness structures cope with the vibration of a building by controlling the stiffness of the whole frame on each story, which requires a complicated control to cope with the bending deformation. According to the present embodiment, a rod-like control member extending over at least a plurality of stories is provided along the posts of the multi-storied building, and upper and lower portions of the control member are respectively connected with portions of the building, preferably with the uppermost and lowermost portions thereof. A variable damping device capable of varying the connecting condition is provided on an intermediate portion or an end portion of the control member, so that the stiffness of the building or the damping force is controlled by means of control of the bending deformation against the vibrational disturbance such as earthquake or wind.

Figure 16:
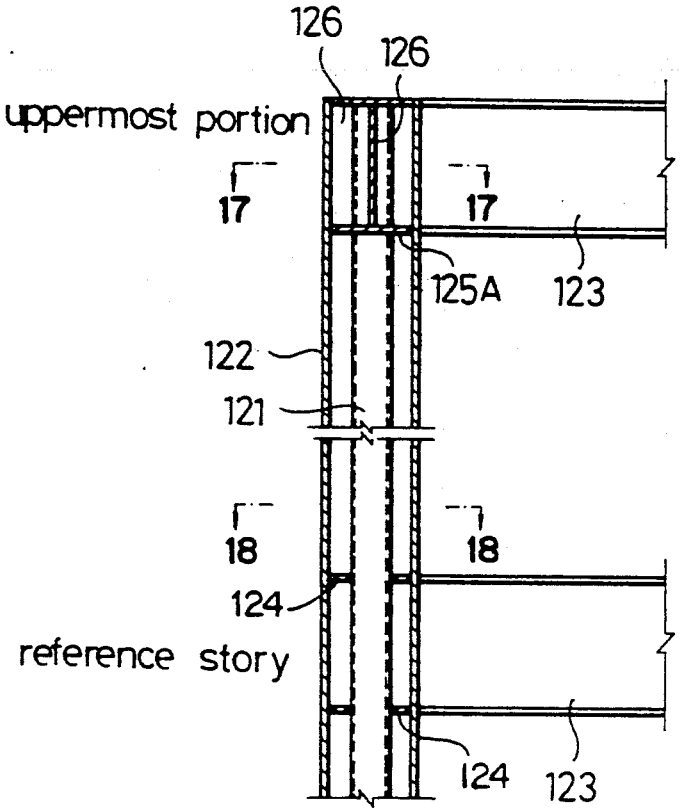
FIG. 16 is an elevational view in section showing a variable damping and variable stiffness structure subjected to bending deformation control.
Figure 17:
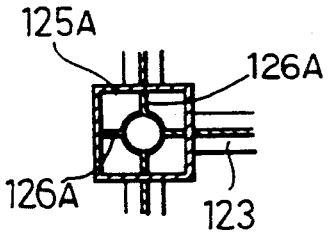
FIG. 17 is a cross-sectional view taken along the line 17—17 of FIG. 16.
Figure 18:
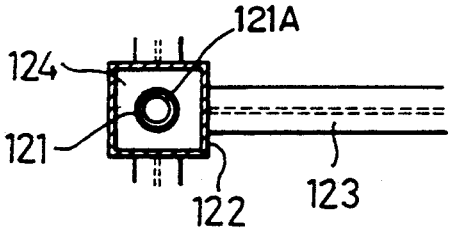
FIG. 18 is a cross-sectional view taken along the line 18—18 of FIG. 16.
Figure 18:
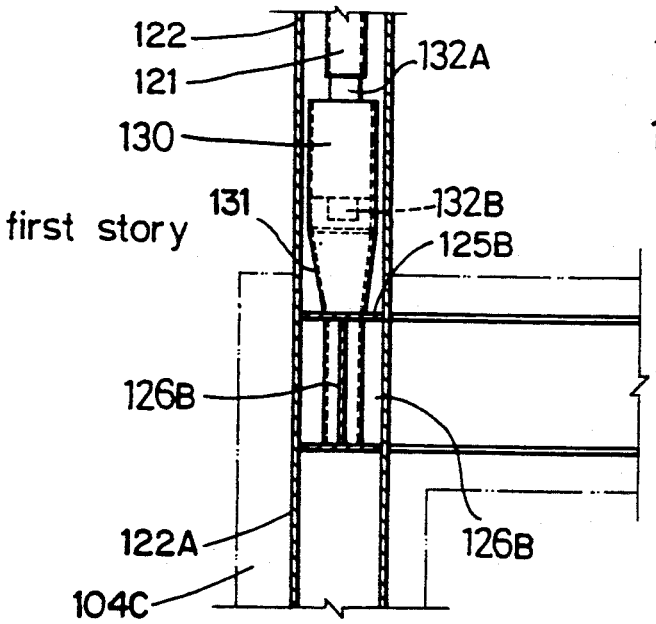

Referring to FIGS. 16 through 18, an interior steel round pipe 121 serving as the control member is installed inside a hollow rectangular post 122 of a high-rise building. The inside steel pipe 121 has the uppermost portion rigidly connected to cruciform vertical connecting plates 126A and to a rectangular diaphragm plate 125A. The lowermost portion of pipe 121 is rigidly secured to cruciform vertical connecting plates 126B and to a rectangular diaphragm plate 125B. An axial force of post 122 on the uppermost portion is transmitted to the inside steel pipe 121, while an axial force of the inside steel pipe 121 at its lowermost portion is transmitted to the underground portion 122A of post 122 and to the foundation 104C. The interior steel pipe 121, at the reference story, FIG. 16, is separated away from diaphragms 124 by means of small annular concentric clearance spaces 121A, shown in FIG. 18, so that the interior steel pipe 121 is capable of shifting in the axial direction relative to the diaphragms 124 according to the condition of a cylinder lock device 130 provided beneath the lower portion of the interior steel pipe 121. The remote ends of the cylinder lock device piston rod are marked by numerals 132A and 132B.

Figure 19:
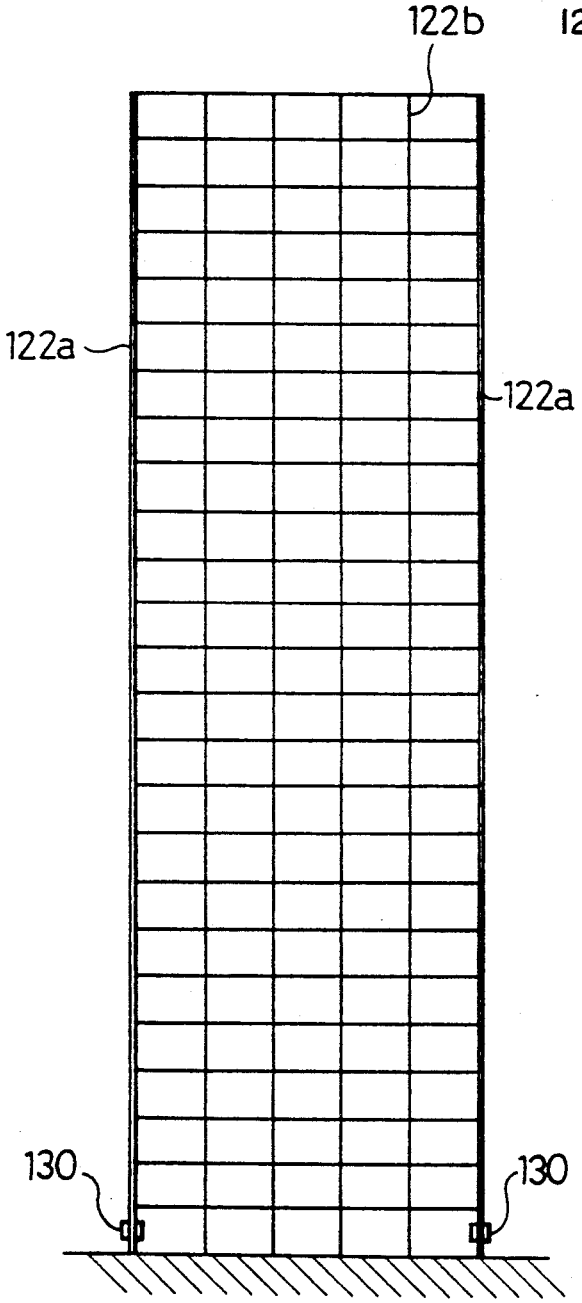
FIG. 19 is a schematic elevational view showing the frame of a building to which an embodiment of the present invention shown in FIG. 16 is applied.
Figure 20:
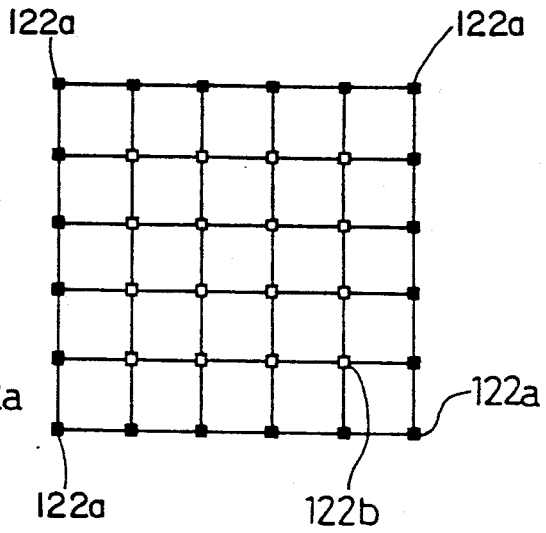
FIG. 20 is a plan view showing the building of FIG. 19.

FIGS. 19 and 20 show the frame of a building, in which the aforementioned double steel pipe damping system shown in FIG. 16 is applied only to the outer posts **122*a* provided on the outer periphery of the building. Posts 122*a* are indicated by solid squares in FIG. 20 and standard posts 122*b* are indicated by the hollow squares. The cylinder lock devices 130 are installed on the first-story portion of the outer posts 122*a***.

Figure 21:
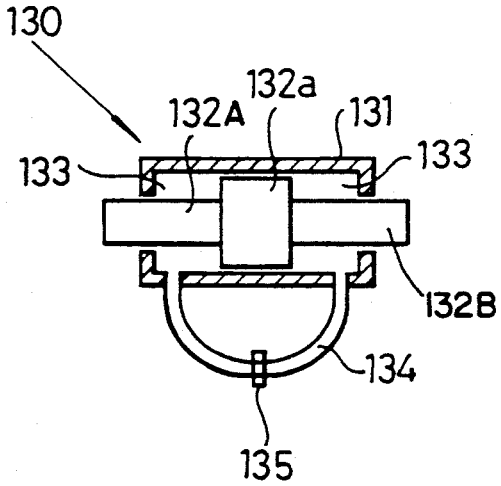
FIG. 21 is a schematic view showing an inventive embodiment of a cylinder lock device serving as a variable damping device according to the present invention.

FIG. 21 is a schematic view showing the cylinder lock device 130 corresponding to that shown in FIG. 3, in which a double-rod piston **132*a* is inserted into a cylinder 131, and a switch valve 135 is provided on an oil path 134 for interconnecting two oil pressure chambers 133 respectively located on opposite sides of the piston 132*a*. The damping force varied by controlling the opening of the switch valve 135 in multiple steps. If the opening of the switch valve 135 is selected between the fully opened condition and the fully closed condition, two conditions of the switch valve 135, i.e., free and locked, are realized. However, computer controlled intermediate valve openings are obtainable in which the damping force provides a resistance proportional to the power of the relative speed of the piston 132*a* to the cylinder 131**.

The cylinder lock device 130 is installed beneath steel pipe 121, and connected thereto so that vertical motion of pipe 121 results in the relative displacement of the piston **132*a* to the cylinder 131 of the cylinder lock device 130**.

As described above, in the case where the cylinder lock device 130 is controlled under only two modes, i.e., free and locked conditions, the control to obtain non-resonance of a structure is accomplished substantially the same as in prior art variable stiffness active seismic response control systems by allowing or restraining the reaction of a building frame to external seismic or wind forces. In addition, however, by controlling the switch valve 135 with computer-commanded digital signals, the orifice may be continuously adjusted to provide the proper damping coefficient of the cylinder lock device 130.

Table 1 and FIGS. 22 through 27 summarize the relationship between the deformed condition of the building and the condition of the cylinder lock device 130.

TABLE 1

Figure 22:
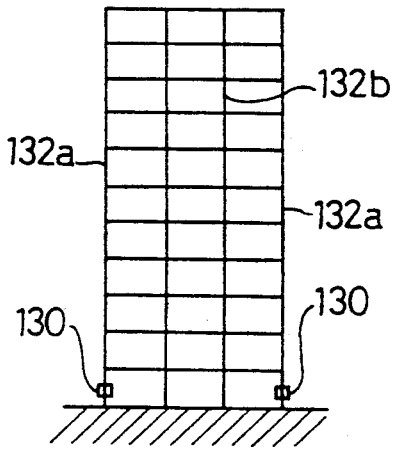
FIG. 22 is a schematic elevational view showing a building under conditions.
Figure 26:
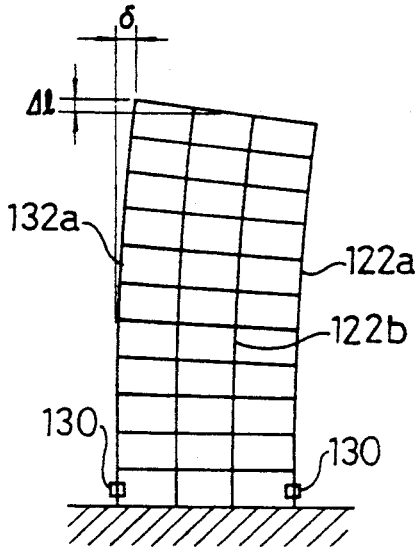
FIG. 26 is a schematic elevational view showing the building of FIG. 22 in a high damping condition or in a locked condition against earthquake tremors and/or wind.
Figure 24:
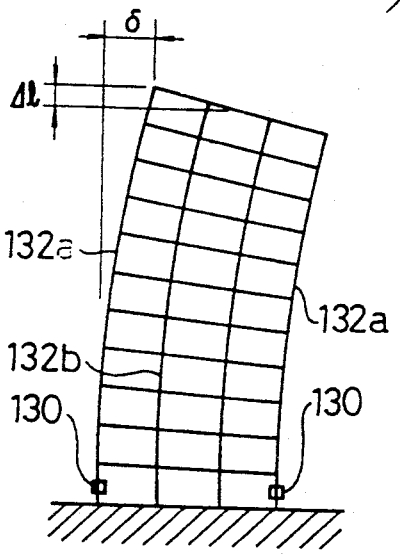
FIG. 24 is a schematic elevational view showing the building of FIG. 22 in a low damping condition or under the free condition against earthquake tremors and/or wind.
Figure 23:
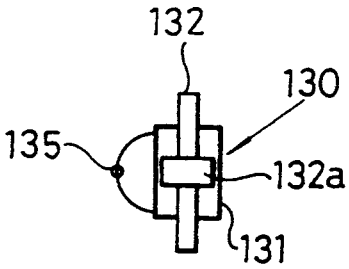
FIG. 23 is a schematic view showing the condition of the inventive cylinder lock device in the building shown in FIG. 22.
Figure 25:
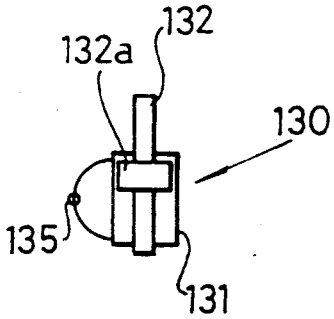
FIG. 25 is a schematic view showing the condition of the inventive cylinder lock device when the building of FIG. 24 is in a low damping condition or under the free condition.
Figure 27:
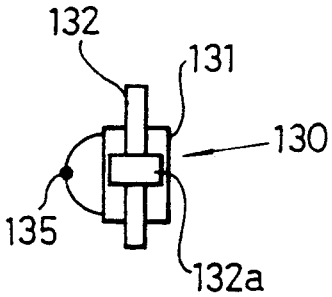
FIG. 27 is a schematic view showing the condition of the inventive cylinder lock device when the building is in a high damping condition or in a locked condition.

| | | earthquake or wind | |
|---|---|---|---|
| load device | normal time | low damping coefficient or free condition | high damping coefficient or locked condition |
| deformed condition of building | FIG. 22 | FIG. 24 | FIG. 26 |
| condition of device | FIG. 23 — | FIG. 25 piston moves without much resistance under almost opened condition of switch valve | FIG. 27 piston moves with much resistance under almost closed condition of switch valve |
| δ | — | large | small |
| Δl | — | large | small |
| T | — | long | short |
| N | 0 | small | large |
| remarks | — | stiffness is soft and natural period is long under condition that inside steel pipe is | stiffness is hard and natural period is short under condition that inside steel pipe is |

TABLE 1-continued

| load device | normal time | earthquake or wind: low damping coefficient or free condition | earthquake or wind: high damping coefficient or locked condition |
|---|---|---|---|
| | | hardly effective | sufficiently effective |

δ: horizontal displacement (uppermost portion)
Δl: expansion and contraction of outer post
T: primary natural period of building
N: axial force of inside steel pipe Under conditions of normal vibrational stress, the building is not deformed, as shown in FIG. 22, and it is not necessary to control the switch valve 135 of the cylinder lock device 130, as shown in FIG. 23.

FIG. 24 illustrates a situation in which the structure is subjected to a high vibrational stress and the cylinder lock device 130 is in the fully open mode, as shown in FIG. 25.

The building shown in FIG. 26 is subjected to the same vibrational stresses as the building shown in FIG. 24. However, in this case, the cylinder lock device is in the fully, or substantially fully, closed mode, as shown in FIG. 27. FIGS. 24 and 26 illustrate the two extremes of seismic response control provided by the subject invention, it being understood that the inventive system is also capable of providing computer programmed intermediate responses best suited to protect the building during a specific seismic or wind imposed vibrational stress and strain.

Numerous modifications and variations of the subject invention may occur to those skilled in the art upon a study of this disclosure. It is therefore to be understood that, within the scope of the appended claims, the invention may be practiced otherwise than as described in the specification and illustrated in the drawings.

What is claimed is:

1. For use with a building structure having frame means of vertical post means, horizontal beam means and variable stiffness means to brace such frame means, a continuously variable active seismic and wind response control system comprising: double acting hydraulic damper means including a piston cylinder; a piston shiftably mounted within said piston cylinder and positioned to define a cylinder chamber on opposite sides of said piston; piston rod means connected to said pistons and having opposite ends adapted to pass axially through said cylinder chambers; means to pass hydraulic fluid between said cylinder chambers responsive to a shifting of said piston axially within said cylinder; valve means to control the rate and volume of flow of said hydraulic fluid between said cylinder chambers; means to secure said piston rod means between said frame means and said variable stiffness means adapted to damp vibrations therebetween; solenoid means adapted to open and close said valve means; a pulse generator adapted to actuate said solenoid means by pulse signals; sensor means located on said building structure adapted to sense and to signal building structure vibrations; computer program means; and computer means programmed by said computer program means to receive signals from said sensor means to analyze said signals and to signal said pulse generator means to actuate said solenoid means responsive to said computer means analysis of said sensor signals, whereby said active seismic and wind control system provides a continuously variable means to dampen seismic and wing vibrations received by a building structure.

2. The continuously variable active seismic and wind response control system of claim 1, wherein said valve means comprises a high speed switch valve having an orifice, and means to open and to close said orifice, which means is regulated responsive to pulse signals from said pulse generator means.

3. The continuously variable active seismic and wind response control system of claim 1, wherein said solenoid means includes a shut-off valve adapted to shut off the flow of hydraulic fluid between said cylinder chambers; and means to apply a hydraulic fluid back pressure to close said valve means when said shut-off valve shuts off the flow of hydraulic fluid between said cylinder chambers.

4. The continuously variable active seismic and wind response control system of claim 3, wherein said shut-off valve is actuated intermittently by said pulse generator.

5. The continuously variable active seismic and wind response control system of claim 4, wherein said pulse signals selectively may be of variable duration.

6. The continuously variable active seismic and wind response control system of claim 5, wherein said system has a determinable coefficient of damping which may be selectively varied by the coaction of said computer, pulse generator, solenoid, shut-off valve subcombination means.

7. The continuously variable active seismic and wind response control system of claim 1, including a hydraulic fluid system interconnecting said cylinder chambers and said valve means, and check valve means adapted to permit the flow of hydraulic fluid only from a first cylinder chamber to a second cylinder chamber responsive to the direction of movement and application of pressure by said piston.

8. The continuously variable active seismic and wind response control system of claim 7, wherein the pressure in said hydraulic fluid system is equalized on opposite sides of said piston when said valve means is fully closed, thereby immobilizing said piston.

9. The continuously variable active seismic and wind response control system of claim 7, wherein said piston is freely shiftable when said valve means is fully open.

10. The continuously variable active seismic and wind response control system of claim 1, including upper and lower horizontal beams, wherein said post means comprises a vertical hollow post having upper and lower ends, and said variable stiffness means comprises an elongated member having upper and lower ends, and being concentrically positioned within said hollow post and vertically extending substantially coterminous therewith; said double acting hydraulic means being positioned within said hollow post beneath the lower end of said elongated member with one of said piston rod ends secured to said lower end of said elongated member and the other of said piston rod ends secured to said lower end of said hollow post; and said upper end of said elongated member being secured to said upper end of said hollow post.

11. The continuously variable active seismic and wind response control system of claim 10, wherein said elongated member is positioned within said hollow posts with a plurality of plates spaced apart throughout said hollow post and secured thereto, and with apertures in said diaphragm plates sized to permit said elongated member to freely pass therethrough.

12. The continuously variable active seismic and wind response control system of claim 11, wherein said hollow post is rectangular in cross section; and said apertures in said diaphragm plates are sized to provide a clearance between said diaphragm plates and said elongated member.

13. The continuously variable active seismic and wind response control system of claim 11, wherein said diaphragm plates are round, the cross section of said elongated member is round, and said elongated member fits concentrically within said apertures.

14. The continuously variable active seismic and wind response control system of claim 13, wherein said elongated member is hollow.

15. The continuously variable active seismic and wind response control system of claim 10, including a casing to house said double acting hydraulic means, said casing being secured to said lower end of said hollow post.

* * * * *